US006662828B1

(12) United States Patent
Stover et al.

(10) Patent No.: US 6,662,828 B1
(45) Date of Patent: Dec. 16, 2003

(54) TELESCOPING FILLING HEAD

(76) Inventors: Clifford W. Stover, 5775 Renninger Rd., Akron, OH (US) 44319; Erik R. Ryberg, 1309 Tioga Ave., Akron, OH (US) 44305; Howard J. Biggins, Jr., 1732 Chestnut Blvd., Cuyahoga Falls, OH (US) 44223

( * ) Notice: Subject to any disclaimer, the term of this patent is extended or adjusted under 35 U.S.C. 154(b) by 0 days.

(21) Appl. No.: 10/154,486

(22) Filed: May 22, 2002

Related U.S. Application Data

(60) Provisional application No. 60/292,753, filed on May 22, 2001.

(51) Int. Cl.[7] ..... B67C 3/00

(52) U.S. Cl. ..... 141/1; 141/146; 141/181; 141/284; 141/39

(58) Field of Search ..... 141/1, 144–152, 141/177, 181, 182, 250, 270, 284, 39, 40; 137/12.5

(56) References Cited

U.S. PATENT DOCUMENTS 2,043,578 A * 6/1936 Markus ..... 222/309
2,168,380 A * 8/1939 Winton ..... 141/250
2,534,997 A * 12/1950 Smith ..... 141/84
2,663,479 A * 12/1953 Detrez ..... 141/47
3,013,591 A * 12/1961 Stanley et al. ..... 141/3
3,097,671 A * 7/1963 Bonnetti et al. ..... 141/116
3,450,174 A * 6/1969 Fievet ..... 141/146
4,938,261 A * 7/1990 Petri et al. ..... 141/39
5,085,255 A * 2/1992 LaWarre et al. ..... 141/39
5,125,440 A * 6/1992 Mette ..... 141/39
5,224,528 A * 7/1993 Helmut et al. ..... 141/353
5,282,500 A * 2/1994 Tanaka et al. ..... 141/301
5,396,936 A * 3/1995 Nalbach et al. ..... 141/144
5,749,403 A * 5/1998 Conforti ..... 141/276
5,924,462 A * 7/1999 McKaughan ..... 141/145

* cited by examiner

*Primary Examiner*—J. Casimer Jacyna

(57) ABSTRACT

A telescoping filling head comprising a driving portion, a nozzle block portion and a two-stage telescoping nozzle, the innermost portion of the nozzle having positionable apertures. A telescoping filling head can be retrofitted on an existing filling device, or can be incorporated in a newly manufactured filling device. The telescoping action permits a longer nozzle to be used in any given space, because the two portions which extend to create a relatively long filling nozzle retract within a relatively short outer nozzle. The longer nozzle increases the rate at which foaming liquids can be introduced into a container. The positionable apertures can also direct the flow of the liquid at the shoulders of the bottle, further increasing the rate at which foaming liquids can be introduced into a container.

33 Claims, 10 Drawing Sheets

FIG. 10
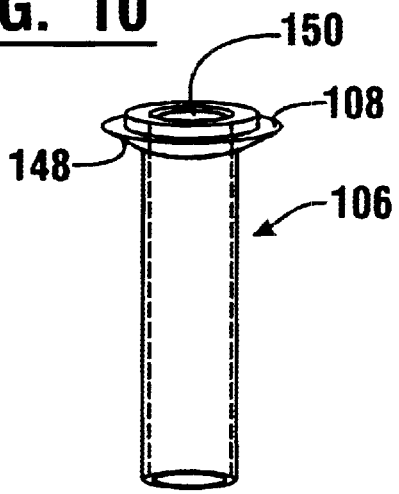
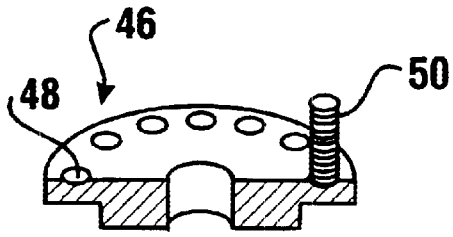
FIG. 14
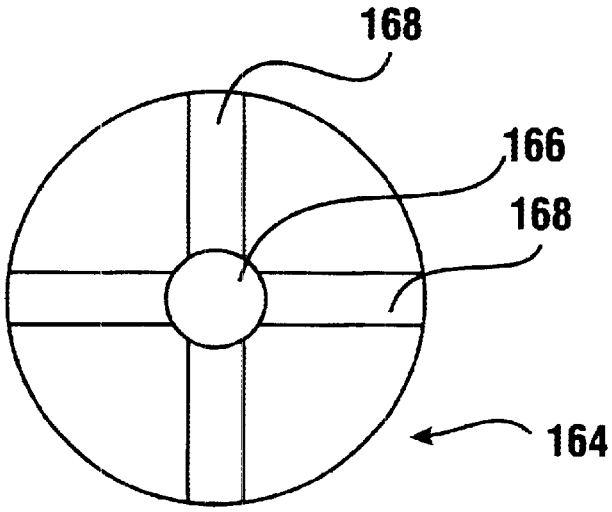
FIG. 13

TELESCOPING FILLING HEAD

CROSS REFERENCE TO RELATED APPLICATIONS

This application claims benefit of U.S. Provisional Application Serial No. 60/292,753 filed May 22, 2001.

TECHNICAL FIELD

This invention relates to filling heads for bottling machines. Specifically, this invention relates to a telescoping filling head which extends from its rest position in two stages, diminishing the need to elevate the bottle onto the nozzle. This filling head may be used to retrofit an existing machine to improve performance when adequate elevation of the existing filling head cannot be obtained. In addition this filling head may be incorporated into new machines to speed up the rate at which liquid can be dispensed into the bottles.

BACKGROUND ART

Liquid filling heads for rotary filling devices are known in the prior art. When a rotary filling device is used in a traditional manufacturing environment, each bottle is elevated to a bottle guide on the filling head. The bottle is held between a bottle guide and a support plate while the bottle is filled using a nozzle which extends through, or is flush with, the bottle guide. This traditional setup is difficult to use to fill tall bottles with liquids, as the liquids tend to foam. To minimize foaming, a longer nozzle can be used, which can be placed closer to the bottom of the bottle and thus submerged in the liquid. If a longer nozzle is used, however, the bottle must be moved under the nozzle and lifted a distance slightly greater than the desired nozzle depth in the bottle. Another option is to introduce the liquid more slowly through a shorter nozzle, which does not extend as deeply into the bottle.

In an existing filling device the amount a bottle can be elevated is limited by the structure of the machine. Thus it may be impossible, particularly when filling tall bottles, to use any currently available longer nozzle to avoid the problem of foaming during filling. This is because there is often insufficient room to lift the bottle enough to accommodate a nozzle that is long enough to dispense the liquid at an appropriate depth. Therefore manufacturers have been forced to use shorter nozzles, which require elevating the bottle less. The use of a shorter nozzle requires that the liquid be dispensed into the bottle at a much slower rate. In addition, when a shorter nozzle must be used with a bottle with a long neck, the longest nozzle that may be accommodated in the existing structure of the filling device may not reach below the neck of the bottle. Because of this, the liquid must be introduced at an even slower rate. These practices increase production costs for the product.

Thus there is a need for a filling head for a rotary filling device which requires only minimal elevation of the bottle and which has a nozzle that can extend deep into the bottle opening during the filling process.

In addition, even where the existing structure of the rotary filling device does not limit the amount the bottle can be elevated, the process of elevating the bottle, and precisely guiding a protruding nozzle into the bottle, slows the filling process. Thus there is a need for a filling head for a rotary filling device which requires minimal or no elevation, which enables faster filling of the bottle, and which may be utilized on either an existing or a newly manufactured machine.

DISCLOSURE OF INVENTION

It is an object of an exemplary form of the present invention to provide a filling head for a rotary filling device which requires minimal elevation of the bottle.

It is an object of an exemplary form of the present invention to provide a filling head for a rotary filling device which permits the insertion of the filling head nozzle into the bottle to a depth greater than the bottle elevation.

It is a further object of an exemplary form of the present invention to provide a filling head for a rotary filling device that permits the introduction of foaming liquids into a bottle more quickly than the currently available filling heads.

It is a further object of an exemplary form of the present invention to provide a filling head for a filling device which can precisely direct the product flow toward the shoulders of the bottle being filled.

It is a further object of an exemplary form of the present invention to provide a filling head for a rotary filling device in which the nozzle depth can be precisely adjusted for use with bottles which have different neck and shoulder configurations.

It is an object of an exemplary form of the present invention to provide a filling head for a rotary filling device that can be retrofitted onto an existing machine.

It is an object of an exemplary form of the present invention to provide a filling head for a filling device that can be used with newly manufactured machines.

It is a further object of an exemplary form of the present invention to provide a filling head that performs the functions described above and that can be fitted to a non-rotary filling device.

Further objects of exemplary forms of the present invention will be made apparent in the following Best Modes For Carrying Out Invention and the appended claims.

The foregoing objects are accomplished in an exemplary embodiment by a filling head which comprises a two-stage telescoping nozzle attached to a nozzle block which may be driven by a pneumatic cylinder. The filling head may be used to dispense liquids into bottles as part of the manufacturing process. The use of the descriptive references herein to bottle is not intended to exclude using a telescoping filling head to fill containers other than bottles. In an exemplary embodiment of this invention, the filling head may be attached to a rotary filling device. In other embodiments, it may be attached to an inline filling device.

In an exemplary embodiment, the bottle to be filled moves toward the filling device. Once it is aligned with the filling head, it may be elevated so that the lip of the bottle is brought flush with a bottle guide that may be attached to the filling head. The lift plate, which elevates the bottle, may hold the bottle tight against the bottle guide during the filling process. In other embodiments, the lip of the bottle may or may not contact the bottle guide, and the bottle may be held stable by other means, with or without elevation.

In an exemplary embodiment once the bottle is seated and secured, a two-part inner nozzle unit may begin to telescope into the opening of the bottle, initially, both parts of the inner nozzle unit move together into the opening in the bottle. The two-part inner nozzle unit may be located inside an outer nozzle. The motion of the outer part of the inner nozzle unit may be stopped when outer flanges on one end butt against the inner end of the outer nozzle. The inner part of the inner nozzle unit continues to move and to slide through the outer part of the inner nozzle unit. When it is fully telescoped, apertures on the inner part of the inner nozzle unit may be revealed. The telescoping movement of the nozzle may be caused by a driving arm that may be attached to a pneumatic cylinder. Although in this exemplary embodiment, the device that powers the driving arm may be a pneumatic cylinder, it should be understood that in other embodiments it may be powered by hydraulic devices, electromechanical devices, or any other device that may be operable to extend and retrieve a telescoping nozzle.

The outer nozzle may be attached to a nozzle block. In this exemplary embodiment, the nozzle block contains an inlet for the introduction of liquids to be dispensed. That inlet may be in fluid connection with a passage through the nozzle block which has an outlet to the outer nozzle. Liquid may flow from the inlet through the nozzle block, into the outer nozzle, into the outer part of the inner nozzle unit, and through the apertures in the inner part of the inner nozzle unit into the bottle. In this exemplary embodiment, there may be one inlet to the nozzle block. In other embodiments there may be more than one inlet to the nozzle block so that more than one kind of liquid may be dispensed, or the same kind of liquid may be dispensed from more than one source.

In an exemplary embodiment, once the bottle is filled, the inner nozzle unit may be pneumatically retracted. It retracts in the reverse order in which it telescoped. Once the telescoping nozzle has been retracted, the bottle can be removed from the filling station. In an exemplary embodiment the bottle may be lowered, which releases it. In other embodiments the release process may include lifting the filling head or releasing the bottle from a holding mechanism.

An adjustable bumper stud may be attached to the surface of the nozzle block, on the side opposite the outer nozzle. The driving arm butts against the bumper stud at the bottom of the telescoping stroke, stopping the telescoping motion of the inner nozzle unit. In an exemplary embodiment in which the lip of the bottle may be held against a bottle guide, the depth to which the nozzle may be inserted in the bottle is approximately equal to the distance between the top of the bumper stud and the base of the driving arm. In other embodiments, in which the bottle guide hovers above the lip of the bottle, the depth of insertion will be slightly less.

Adjustments may be made to the depth of the nozzle insertion by adjusting the height of the bumper stud. In an exemplary embodiment, in which the bottle guide holds the bottle, minor adjustments to the depth of the nozzle insertion may also be made by adjusting the bottle guide position with respect to the outer nozzle.

In an exemplary embodiment, the orientation of the apertures in the perforated portion of the inner nozzle unit may be fixed by means of a ring attached to the top of a nozzle holder. The ring on the nozzle holder contains detents on its upper surface, near the edge, into which a spring plunger may be snapped to fix the position. In other embodiments, there may be other mechanisms for selecting and adjusting the orientation of the apertures in the perforated portion of the inner nozzle. In addition the filling head may be fitted with two springs, which bias the filling head to return it to the closed position in the event the driving device fails.

BRIEF DESCRIPTION OF DRAWINGS

FIG. 10 is a partial cutaway perspective view of the telescoping nozzle.

FIG. 13 is a view of the second end of the bottle guide.

FIG. 14 is a partial cutaway perspective view of the spring guide.

BEST MODES FOR CARRYING OUT INVENTION

Figure 1:
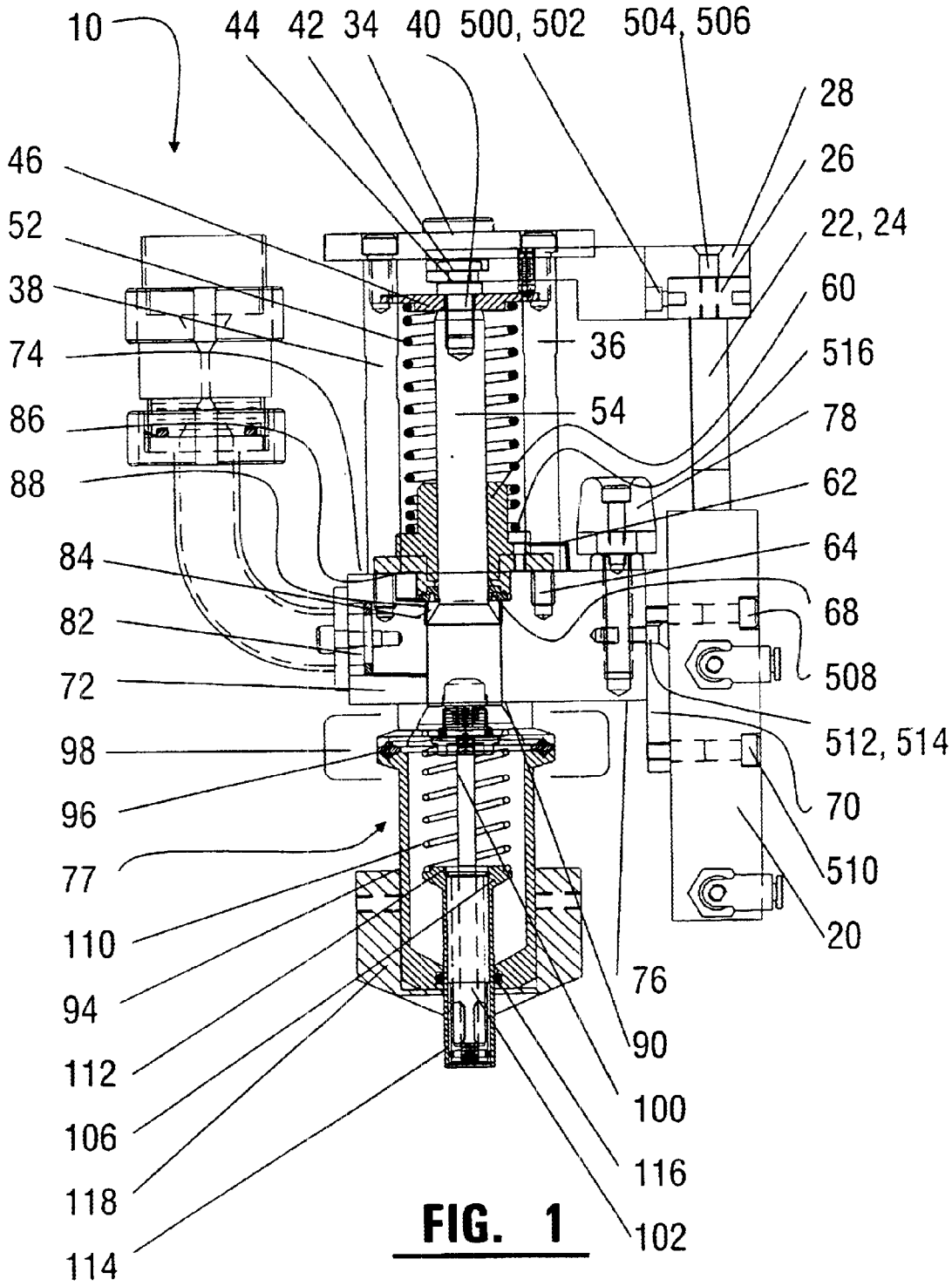
FIG. 1 is a cutaway perspective view of the filling apparatus at rest for one exemplary embodiment of the present invention.
Figure 2:
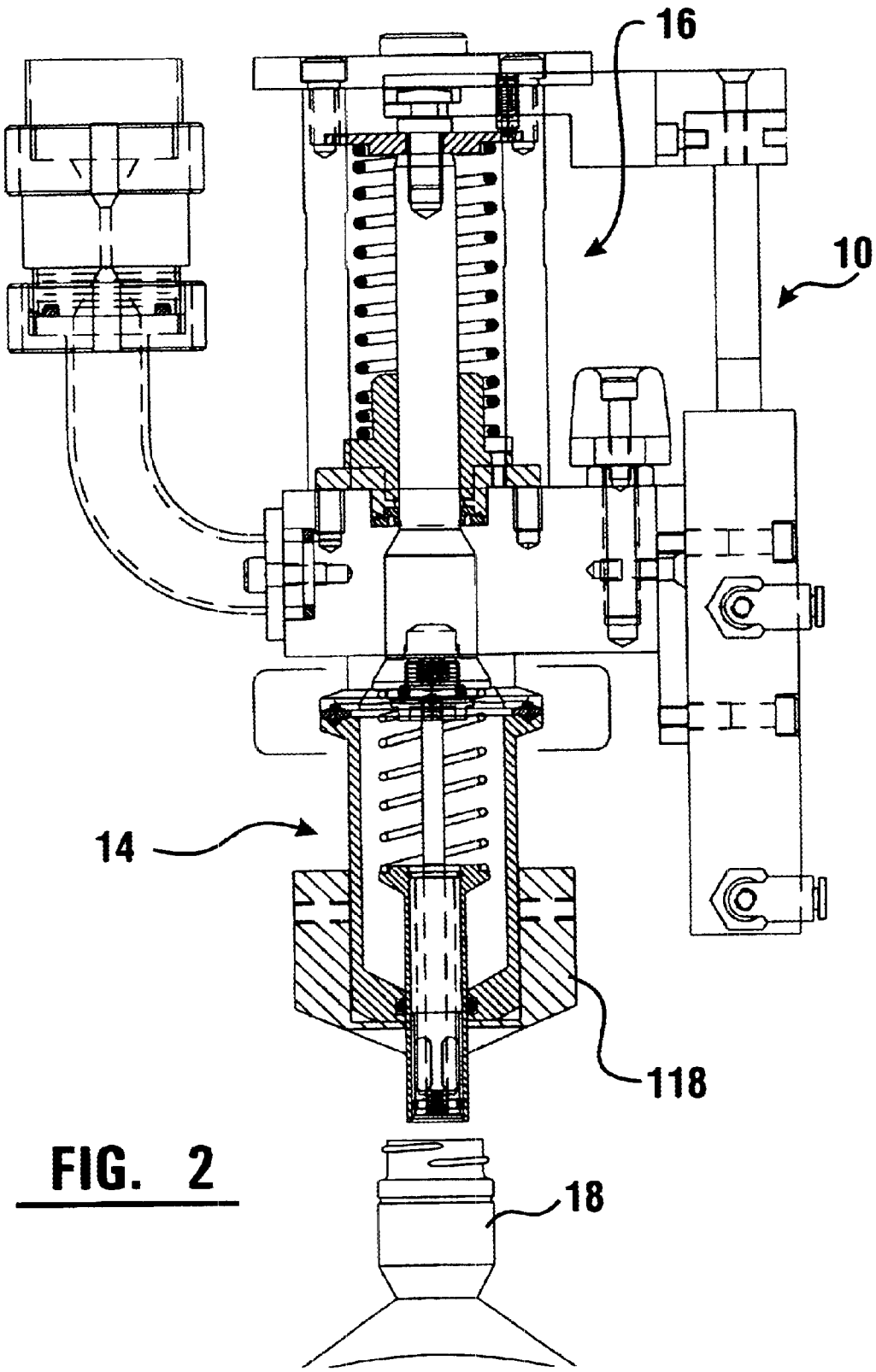
FIG. 2 is a cutaway perspective view of the filling apparatus with the bottle in the initial position.

Referring now to the drawings, and particularly to FIGS. 1 and 2, there is shown therein an exemplary embodiment of a telescoping filling head, generally indicated 10. The telescoping filling head 10 includes a nozzle portion 14, a driving portion 16, a driving arm 28, and an air cylinder 20. The air cylinder 20, driving arm 28, and driving portion 16 are adapted to extend and retract the nozzle portion 14.

In an exemplary embodiment, the nozzle portion 14 may be driven by an air cylinder 20. It should be understood that in other embodiments it may be driven by other devices adapted to telescope and retract the nozzle portion 14 of the telescoping filling head 10, including hydraulic devices, motors, or other fluid, mechanical, or electrical driving devices. In addition, although in this exemplary embodiment the air cylinder 20 is shown in parallel with the nozzle and driving portions 14, 16 of telescoping filling head 10, in other embodiments it may be placed in series with the nozzle portion 14 and driving portion 16, driving the nozzle portion 14 directly.

The driving portion 16 includes first and second driving rods 22 and 24 which are slidably inserted in the upper surface of the air cylinder 20. Both the first and second driving rods 22 and 24 are fixedly attached to the base of a driving plate 26, which, in this exemplary embodiment, may be a rectangular block. A driving arm 28 may be fixedly attached to the driving plate 26.

Figure 6:
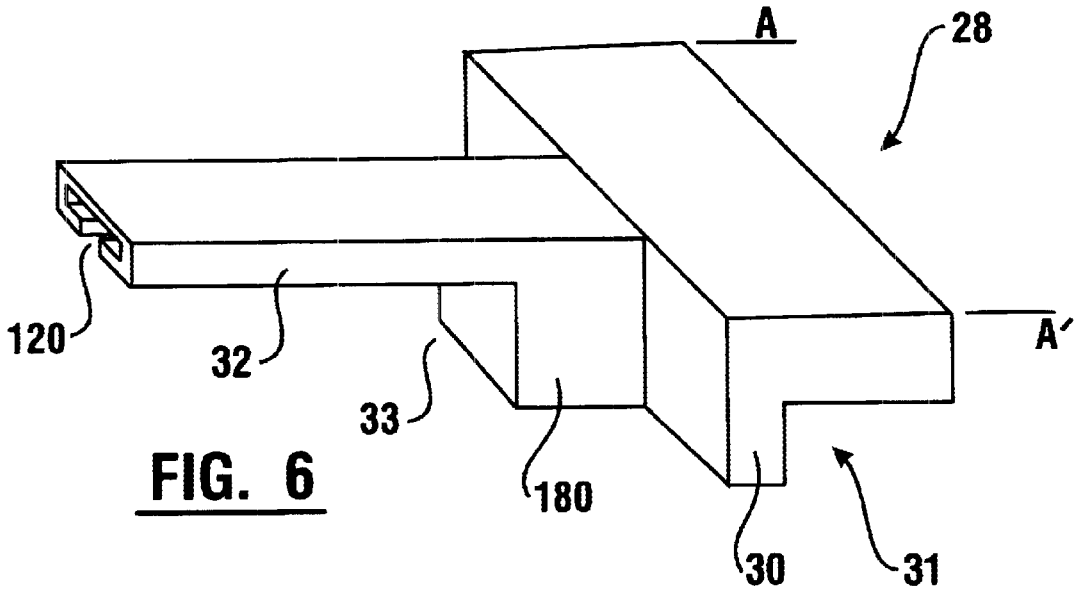
FIG. 6 is a perspective view of the driving arm.

The driving arm 28 is shown in more detail in FIG. 6. When viewed from the perspective shown in FIG. 6, the driving arm 28 may include a thick block in the shape of a "T" with portions of the underside removed. In this exemplary embodiment, the driving arm 28 comprises first and second portions 30 and 32. The first portion 30 of the driving arm 28, the bar of the "T," may be attached to the driving plate 26. The second portion 32 of the driving arm 28, the stem of the "T," extends into the driving portion 16 of the telescoping filling head 10 and may be perpendicular to the driving rods 22 and 24.

In this exemplary embodiment, a rectangular block shaped portion may be removed from the underside, as viewed from the perspective in FIG. 6, of the first portion 30 of the driving arm 28. The cutaway portion 31 has dimensions which may match those of the driving plate 26 so that the driving plate 26 may fit precisely in the cutaway portion 31 of the first portion 30 of the driving arm 28. In this exemplary embodiment, the driving arm 28 may be fixedly attached to the driving plate 26 by fasteners such as screws 500, 502, 504, and 506. In this exemplary embodiment the width of the first portion 30 of the driving arm 28, shown A–A' in FIG. 6, may be the same as the width of the corresponding dimension of the driving plate 26. In other embodiments, the width of the driving plate 26 and first portion 30 of the driving arm 28 may not be identical. In this exemplary embodiment, driving plate 26 may be attached to the driving arm 28 by the use of four screws. In other embodiments, the attachment may be accomplished by different fasteners, or by using fewer or more screws.

In like manner, a part of the second portion 32 of the driving arm 28 also contains a cutaway portion 33 from below, from the FIG. 6 perspective, leaving the second portion 32 of the driving arm 28 with a thickened area 180 adjacent to the first portion 30 of the driving arm 28. This gives the driving arm 28 strength to perform the driving function. In an exemplary embodiment a T-slot 120 has been cut in the underside, from the FIG. 6 perspective, of the extreme end of the second portion 32 of the driving arm 28. The T-slot 120 may be sized so that the cap of an alignment compensator 40 may be slid loosely into the T-slot 120.

In an exemplary embodiment, a mounting plate 70 may be attached to the flat surface of an air cylinder 20 on the same side as the second portion 32 of the driving arm 28. The mounting plate 70 may be a thin rectangular block. A thick, roughly rectangular, nozzle block 72 may be fixedly attached to the mounting plate 70 before attaching the mounting plate 70 to an air cylinder 20. In this exemplary embodiment, screws 512, 514 are inserted through the mounting plate 70 into one end of the nozzle block 72. A mounting plate 70 may then be attached to an air cylinder 20 by screws 508, 510 that are inserted through holes in the mounting plate 70 into the body of the air cylinder 20. Although in this exemplary embodiment the mounting plate 70 may be attached to the air cylinder 20 by two screws and to the nozzle block 72 by two screws, in other embodiments it may be attached by different connecting devices, fasteners, or by different numbers of screws.

Figure 15:
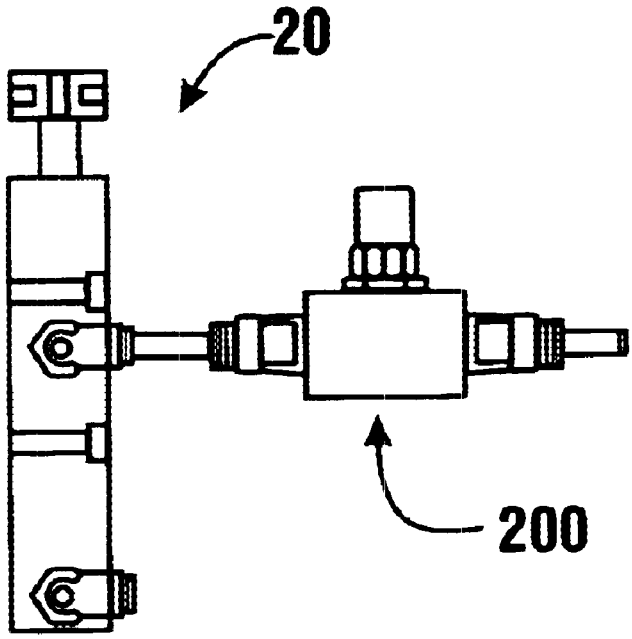
FIG. 15 is a representational view of a flow control valve

An air cylinder 20 may be adapted to include a flow control valve 200, illustrated in FIG. 15 in operative connection with valve of the air cylinder 20 which exhausts the air cylinder 20 during the retraction of the telescoping filling head 10, for the purpose of slowing the first stage of the retraction.

The nozzle block 72 may be a rectangular block with a cylindrical opening, inlet 82, on the end of the nozzle block 72 that may be opposite the mounting plate 70. Although in this exemplary embodiment the inlet 82 may be on the end of the nozzle block 72 opposite the mounting plate 70, it should be understood that in other embodiments the inlet 82 may appear on other surfaces of the nozzle block 72. In addition, in other embodiments there may be more than one inlet 82 to the nozzle block 72. In still other embodiments, an inlet 82 may appear elsewhere on the telescoping filling head, so long as the inlet 82 is in fluid connection with the inner nozzle 100.

The nozzle block 72 also has a roughly cylindrical passage 84 through the block that may be perpendicular to and in fluid connection with an inlet 82. In an exemplary embodiment, the passage 84 may be generally in the shape of a stepped cylinder. The first portion 86 of the passage 84, near the first surface 74 of the nozzle block 72, has a diameter greater than that of the second portion 88 of the passage 84. The transition between the first portion 86 and the second portion 88 may be stepped.

Moving to the telescoping filling head portion, an extension 77 protrudes from and may be perpendicular to the second surface 76 of the nozzle block 72. The exterior of the extension 77 has a stepped cylindrical shape with a first portion, adjacent to the second surface 76 of the nozzle block 72, with a smaller diameter. The extension 77 also has a second portion, farther away from the nozzle block 72, with a larger diameter. The transition between the two portions may be predominately stepped, but has a slight taper to accommodate clamping by a sanitary seal 98. The interior shape of the extension 77 may be that of a truncated cone, with the smallest base of the truncated cone closest to the second surface 76 of the nozzle block 72. The taper on the cone matches the taper on the end of the second portion of the nozzle holder 54.

The largest base of the truncated cone has a diameter that is generally smaller than the exterior diameter of the second portion of the extension 77, creating a surface on the extension that is generally parallel to the second surface 76 of the nozzle block 72. This surface may contain an annular groove 158. The annular groove 158 may be adapted to accept a tri-clamp gasket 96.

The nozzle portion of the filling head 14 extends from the extension 77 from the second surface 76 of the nozzle block 72 toward the bottle 18 to be filled. The driving portion of the filling head 16 extends in the opposite direction from the first surface 74 of the nozzle block 72.

Beginning with the driving portion of the filling head 16, first and second cap support rods 36 and 38 are generally perpendicular to the first surface 74 of the nozzle block 72 and may be fixedly attached to the nozzle block 72. The opposite ends of the first and second cap support rods 36 and 38 may be fixedly attached to an alignment cap 34. In this exemplary embodiment, the cap support rods 36 and 38 may be externally threaded at the end that may be attached to the nozzle block 72, and may be screwed into the nozzle block 72. The opposite ends are attached to the alignment cap 34 by means of screws that pass through the alignment cap 34 into threaded recesses in the ends of cap support rods 36 and 38. Although the cap support rods 36 and 38 are attached in this embodiment by means of screws or threading that may be machined directly onto or into the part, it should be understood that in other embodiments, the cap support rods 36 and 38 may be attached with other types of fasteners. It should also be understood that although there are two cap support rods 36 and 38 in this embodiment, that there may be a different number of cap support rods in other embodiments.

In this exemplary embodiment, the alignment cap 34 may be a thick circular plate. A rectangular groove has been cut from the bottom of the alignment cap 34 along a diameter. The groove may be oriented so that it is generally parallel to the driving arm 28. Although in this embodiment the alignment cap 34 may be a circular plate with a rectangular groove, it should be understood that in other embodiments it may have a different shape which functions in a similar manner.

When the telescoping filling head 10 is at rest, the second portion of driving arm 32 fits very loosely into the groove on the alignment cap 34, and may be located between the alignment cap 34 and the nozzle block 72. An alignment compensator 40 may be loosely fitted into the T-slot 120 in the driving arm 28. The alignment compensator 40 resembles a double headed bolt with a second head 44 parallel to the first head 42 and connected to the first head 42 by a short stem. The first head 42, which is farthest away from the threaded portion, comprises a circular the stem of the bolt between the two heads may be of a diameter appropriate to slide easily through the stem portion of a T-slot 120. The second head 44 comprises a second thin circular plate, with two diametrically opposite sides of the second circular plate flattened so that it may be gripped for tightening. Although in an exemplary embodiment two sides of the second head 44 are flattened to permit tightening, in other embodiments different mechanisms may be used for this purpose. Similarly, although in an exemplary embodiment the alignment compensator resembles a double headed bolt, in other embodiments alignment compensation may be accomplished by alignment compensators of a different nature or appearance.

Figure 11:
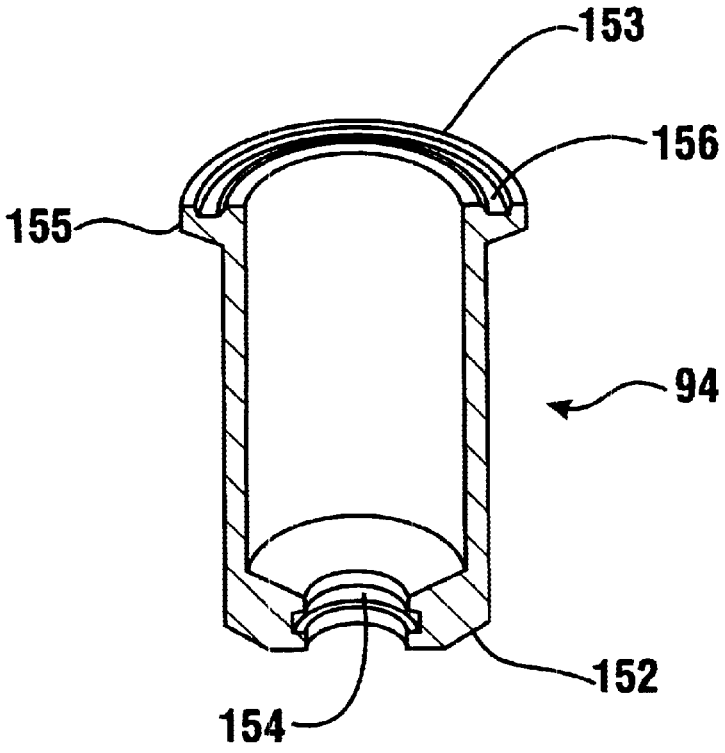
FIG. 11 is a partial cutaway view of the outer nozzle.

The threaded portion of the alignment compensator 40 may be placed through a hole in a spring guide 46 shown in more detail in FIG. 11. A spring guide 46 may be a thin circular plate with a stepped diameter comprising a first portion of greater diameter than that of a second portion. The first portion of the spring guide 46 may be adjacent to the second head 44 of the alignment compensator 40. The diameter of the first portion of the spring guide 46 may be a few times that of the heads 42 and 44 of the alignment compensator 40, and is generally greater than the exterior diameter of the compression spring 52, which it guides, and which is discussed in more detail below. The diameter of the second portion of the spring guide 46 may be approximately equal to the interior diameter of the compression spring 52.

Figure 7:
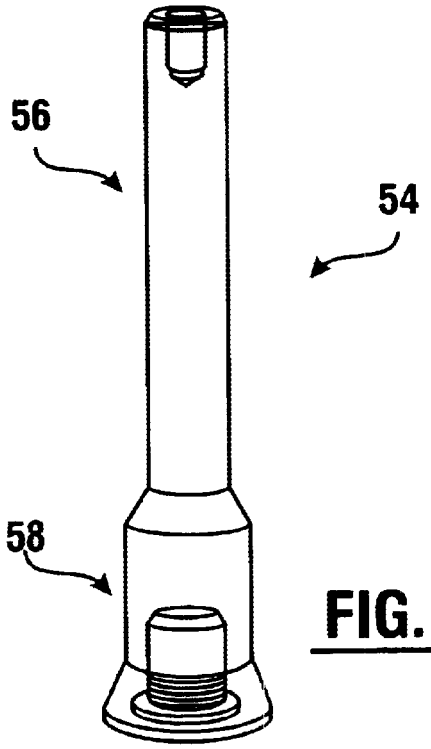
FIG. 7 is a partial cutaway perspective view of the nozzle holder.

After passing through the spring guide 46, the threaded portion of an alignment compensator 40 may be screwed into one end of a nozzle holder 54. An exemplary embodiment of a nozzle holder 54 is illustrated in FIG. 7. In an exemplary embodiment, a nozzle holder 54 comprises a rod with first and second portions 56 and 58. The end of the first portion 56 of the nozzle holder 54 may be internally threaded to accommodate the threads on the alignment compensator 40. The first portion 56 of nozzle holder 54 generally has a smaller diameter than the second portion 58 of the nozzle holder 54. The transition between the first portion 56 of the nozzle holder 54 and the second portion 58 of nozzle holder 54 may be tapered, so that the change in diameters may be gradual rather than stepped. In this exemplary embodiment, the end of the second portion 58 of nozzle holder 54 tapers outward, in a manner similar to the transition between the first and second portions 56 and 58 of nozzle holder 54.

Extending from the tapered part at the end of the second portion 58 of nozzle holder 54 may be an additional short cylindrical portion with an exterior diameter that generally matches the inner diameter of a spring 110, discussed in more detail below. The transition between this flared portion of the nozzle holder 54 and the cylindrical portion of a smaller diameter may be stepped. The end of the second portion 58 of nozzle holder 54 may be internally threaded to accommodate the threads of an inner nozzle 100, discussed in more detail below. An annular groove may be cut into the inner surface of the end of the second portion 58 of nozzle holder 54 and may contain an inner nozzle holder O-ring 92.

Figure 8:
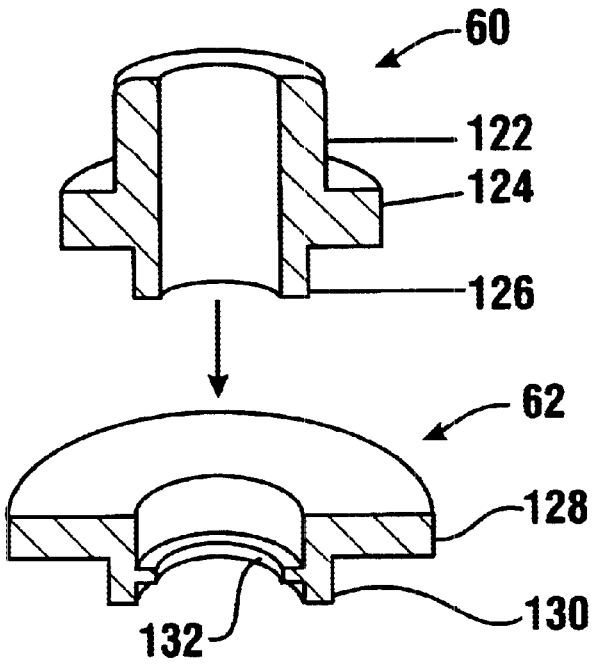
FIG. 8 is an exploded partial cutaway view of the first and second nozzle bushings.

The nozzle holder 54 extends from the base of the spring guide 46 through the previously described passage 84 in the nozzle block 72. Surrounding the nozzle holder 54, and attached to and seated in the first portion 86 of the passage 84 are first and second nozzle bushings 60 and 62. These bushings are illustrated in FIG. 8. The first nozzle bushing 60 comprises a plastic cylindrical tube with a uniform inner diameter and an outer surface that comprises three steps. The inner diameter of the first nozzle bushing 60 may be approximately equal to the diameter of the first portion 56 of the nozzle holder 54. The first portion 122 of the first nozzle bushing 60, the portion farthest away from the nozzle block 72, has an exterior diameter approximately equal to that of the inner diameter of a compression spring 52. The next, second portion 124 of the first nozzle bushing 60, has a larger outer diameter. The third portion 126 of the first nozzle bushing 60 has a diameter smaller than the diameter of the first portion. Although in an exemplary embodiment bushings of a particular design are described, bushings of a different but functionally equivalent design or functionally equivalent components other than bushings may be used in other embodiments.

In this exemplary embodiment, the second nozzle bushing 62, can be described in three portions. A first portion 128 of the second nozzle bushing 62 may be a thin circular plate with a hole in the center. The outer diameter of the first portion 128 of the second nozzle bushing 62 may be larger than the outer diameter of the second portion 124 of the first nozzle bushing 60. The inner diameter of the first portion 128 of the second nozzle bushing 62 may be approximately equal to the outer diameter of the third portion 126 of the first nozzle bushing 60.

A second portion 130 of the second nozzle bushing 62 generally comprises a thin cylindrical tube extending into the nozzle block 72, with an exterior diameter approximately equal to the interior diameter of the first portion 86 of the passage 84. The interior diameter of the second portion 130 of the second nozzle bushing 62 may be approximately equal to the exterior diameter of the third portion 126 of the first nozzle bushing 60.

A third portion of the second nozzle bushing 62 generally comprises a flat ring 132 extending inward from the inner surface of the second portion 130 of the second nozzle bushing 62. The interior diameter of this ring 132 may be slightly larger than the diameter of the first portion 56 of the nozzle holder 54. The ring 132 may be formed at an appropriate depth so that the bottom of the first nozzle bushing 60 abuts the ring 132 when the first and second nozzle bushings 60 and 62 are properly seated in the nozzle block 72.

As noted above, although in an exemplary embodiment bushings of a particular design are described, bushings of a different but functionally equivalent design or functionally equivalent components other than bushings may be used in other embodiments.

An inner nozzle seal 68, which may be a shaped gasket adapted to form a seal between a second nozzle bushing 62 and the first portion 56 of the nozzle holder 54, may be seated in the base of the first portion 86 of the passage 84. The second portion 130 of the second nozzle bushing 62 fits into the first portion 86 of the passage 84 and abuts the inner nozzle seal 68. The first portion 128 of the second nozzle bushing 62 may be held flat against the first surface 74 of the nozzle block 72 by means of keepers, of which one is shown and labeled with reference numeral 64. Keepers 64 comprise roughly L-shaped tabs, the bases of which extend over the first portion 128 of the second nozzle bushing 62. The keepers 64 in this exemplary embodiment are attached to the nozzle block 72 by screws. In this exemplary embodiment, there are two keepers 64 which are diametrically opposite each other, and which are attached by screws. In other embodiments, fewer or more or different connecting devices or fasteners may be used.

The third portion 126 of the first nozzle bushing 60 fits into the cylindrical second portion 130 of the second nozzle bushing 62: The step between the second portion 124 of the first nozzle bushing 60 and the third portion 126 of the first nozzle bushing 60 may be flush with the outer surface of the first portion 128 of the second nozzle bushing 62. The second portion 122 of the first nozzle bushing 60 may be attached to the first portion 128 of the second nozzle bushing 62 by means of three screws, of which one is shown and labeled with reference numeral 516.

Extending between the spring guide 46 and the first nozzle bushing 60, and surrounding nozzle holder 54, may be a compression spring 52. The compression spring 52 has an inside diameter approximately equal to the diameter of the second portion of the alignment cap 34 and the exterior diameter of the first portion 122 of the first nozzle bushing 60. The spring may be biased to push the driving arm 28 away from the nozzle block 72, in the absence of an opposing force. Although in an exemplary embodiment the biasing force is provided by a spring, in other embodiments it may be beneficial to use a different device to bias the driving arm 28 away from the nozzle block 72.

Moving now to the nozzle portion 14 of the telescoping filling head 10, as shown in FIG. 1 this portion extends away from the second surface 76 of the nozzle block 72. It comprises an inner nozzle 100, an inner nozzle tip 102, a telescoping nozzle 106, a spring 110, and an outer nozzle 94. In addition, the nozzle portion 14 of the telescoping filling head 10 includes various gaskets and O-rings which seal various connections or openings to prevent leakage. The inner nozzle 100, nozzle tip 102 and telescoping nozzle 106 comprise the inner nozzle unit 12.

Figure 9:
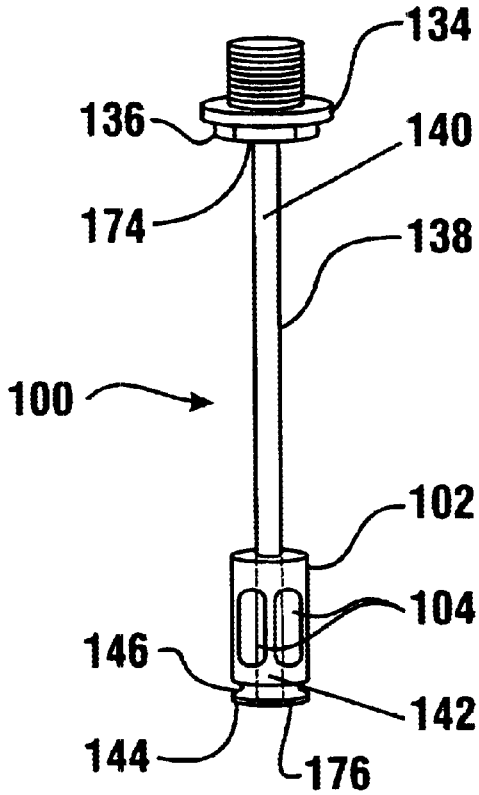
FIG. 9 is a partial cutaway perspective view of the inner nozzle.

An exemplary embodiment of an inner nozzle 100 and an inner nozzle tip 102 are illustrated in FIG. 9. The inner nozzle 100 has first and second ends 174, 176. The first end comprises a threaded portion with the same diameter as the threaded hole in the base of nozzle holder 54. Adjacent to the threaded portion may be a thin circular first plate 134 with an exterior diameter smaller than the inner diameter of the spring 110. Extending from the circular plate may be a thin second plate 136, with an angular perimeter that can be grasped to attach the inner nozzle 100 to the nozzle holder 54. Extending perpendicular to these plates may be a thin circular rod 138 with first and second ends 140, 142, the first end 140 being attached to the second plate 136. Although in this exemplary embodiment, the second plate 136 that may be gripped to attach the inner nozzle 100 to the nozzle holder 54 may be square, in other embodiments it may have a different shape that would permit it to be gripped for tightening. In addition, although in this exemplary embodiment the inner nozzle 100 and the nozzle holder 54 are distinct components of the telescoping filler head 10, in other embodiments it may be beneficial to use a nozzle unit comprising the combination of the inner nozzle 100 and the nozzle holder 54.

Attached to the second end 142 of the rod 138 may be an inner nozzle tip 102. The nozzle tip 102 comprises a hollow cylinder or passage that may be closed at one end by a flat surface that is generally perpendicular to the cylindrical walls. The second end 142 of the circular rod 138 may be inserted into the hollow center of the nozzle tip 102, and may be attached to the nozzle tip 102 approximately at the center of the flat surface of the closed end of the nozzle tip 102. The external diameter of the nozzle tip 102 may be smaller than the diameter of the first plate 134 and may be approximately equal to the inner diameter of the telescoping nozzle 106. The nozzle tip 102 may have one or more apertures 104 in its cylindrical walls, near the closed end. The exterior of the nozzle tip 102 may contain an annular groove 146 near the closed end. The annular groove 146 may be adapted to hold a nozzle tip O-ring 114. The nozzle tip O-ring 114 may seal the nozzle tip 102 against the telescoping nozzle 106 except when the telescoping filling head 10 is in the filling position.

In this exemplary embodiment, the inner nozzle unit 12 further comprises the telescoping nozzle 106. An exemplary telescoping nozzle 106 is illustrated in FIG. 10. The telescoping nozzle 106 comprises a cylindrical tube or passage with an outer tapered flange 148 at a first end, the first end being closest to the nozzle block 72. The outer portion of the flange 148 with the largest diameter may be cut away to create a lip 108. The inner perimeter of the lip 108 has a diameter approximately equal to the inner diameter of spring 110. The inner diameter of the telescoping nozzle 106 maybe constant, with the exception of a small annular groove 150 near the first end which may be adapted to hold a retaining ring 112.

The telescoping nozzle 106 surrounds the inner nozzle 100. In the rest position, the second end of the telescoping nozzle 106 may be flush with the second end 176 of the inner nozzle 100. In the filling position, the telescoping nozzle 106 has moved toward the first end 174 of the inner nozzle 100, revealing the apertures 104 in the inner nozzle tip 102.

In this exemplary embodiment the spring 110 surrounds the rod 138 of the inner nozzle 100. It abuts the second end of the nozzle holder 54, surrounding the cylindrical portion that extends from the flange 148. The spring 10 extends from the end of the second portion 58 of the nozzle holder 54 to a lip 108 on the first end of a telescoping nozzle 106, and surrounds rod 138 of the inner nozzle 100. The spring 110 may be biased to force the nozzle holder 54 and the telescoping nozzle 106 apart, in the absence of an opposing force. Although in an exemplary embodiment a spring provides the biasing force, in other embodiments it may be beneficial to use a different device to bias the nozzle holder 54 away from the telescoping nozzle 106.

In this exemplary embodiment the circular plate 134, at the first end 174 of the inner nozzle 100, the inner nozzle tip 102 at the second end of the inner nozzle 100, the cylindrical extension on the second portion 58 of nozzle holder 54, and the spring 110 have at least one cross section that may be generally circular. In other embodiments, these cross sections may have different shapes, so long as the parts that fit together to drive the telescoping motion are of the same shape and cooperating dimensions.

Surrounding the inner nozzle unit 12 described above, may be an outer nozzle 94 illustrated in FIG. 11. The outer nozzle 94 comprises a cylindrical tube or passage having a first and second end. The second end 152 of the outer nozzle 94, the end farthest from the nozzle block 72, may be partially closed and has a hole through the end with a diameter that may be approximately equal to the exterior diameter of the telescoping nozzle 106. The inner shape of the second end 152 of the outer nozzle 94 matches the flanges 148 at the first end of the telescoping nozzle 106. The partially sealed second end 152 of the outer nozzle 94 may be relatively thick, permitting an annular groove 154 to be formed in the wall of the hole through the second end 152, into which a telescoping seal O-ring 116 may be seated. The telescoping seal O-ring 116 may seal the outer nozzle 94 against the telescoping nozzle 106.

The first end 153 of the outer nozzle 94 may be open and may have an outer flanged portion 155 that approaches a stepped shape. The outer diameter of the flanged portion 155 of the outer nozzle 94 may be approximately equal to the largest outer diameter of the extension 77 on the bottom of the nozzle block 72. The flanged portion 155 of the first end of the outer nozzle 94, which may abut the extension on the bottom of the nozzle block 72 when clamped together with it, contains an annular groove 156. The groove may be of the same diameter as the annular groove 158 in the extension 77 of the nozzle block 72, and may be also adapted to accept a tri-clamp gasket 96. After seating a tri-clamp gasket 96 in the matching grooves 156, 158, the outer nozzle 94 may be clamped to the extension 77 of nozzle block 72 by means of a sanitary seal 98, known to those skilled in the art. Although in this exemplary embodiment the outer nozzle 94 and the nozzle block 72 are connected by a sanitary clamp, in other embodiments the connection may be made differently. In addition, in some embodiments it may be desirable to form the outer nozzle 94 and the nozzle block 72 as a single component.

Figure 12:
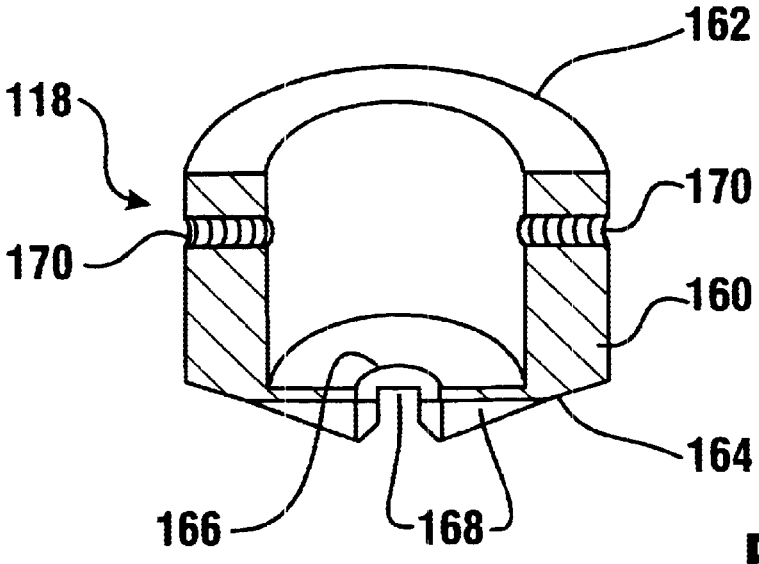
FIG. 12 is a partial cutaway view of the bottle guide.

Partially surrounding the outer nozzle 94 may be a bottle guide 118 illustrated in FIGS. 12 and 13. The bottle guide 118 comprises a short plastic cylindrical tube 160 with an inner diameter approximately equal to the outer diameter of the outer nozzle 94 having first and second ends 162, 164. The cylindrical tube may be partially closed at the second end 164 of the bottle guide 118 that is farthest from the nozzle block 72 and has a conical shaped base containing a central hole 166. The hole 166 has a diameter approximately equal to the outer diameter of the telescoping nozzle 106. Two rectangular grooves 168 that are perpendicular to each other, and meet at the central hole 166, may be cut across the conical second end 164 of the bottle guide 118. These grooves 168, shown more clearly in FIG. 13, permit gases to escape from the bottle 18 as it is being filled with liquid. The exemplary cylindrical tube 160 illustrated contains four set screws, of which two are shown and labeled with reference numeral 170. These set screws 170 are adapted to fix the position of the bottle guide 118 relative to the outer nozzle 94. Although four set screws 170 are used in this exemplary embodiment, other embodiments may use fewer or more screws or a different method of attaching the bottle guide.

In this exemplary embodiment, a bumper stud 78 may be attached to the first surface 74 of nozzle block 72 and positioned in line with the thickened area 180 of the second portion 32 of driving arm 28. The bumper stud 78 comprises a bolt with a shock absorbent stopper attached to its head. The bumper stud 78 may be screwed into a hole in the nozzle block 72. Threaded onto the screws of the bolt portion of the bumper stud 78, between the head and the nozzle block 72, may be a lock nut 80. The lock nut 80 may be used to lock the bumper stud 78 at a particular elevation with respect to the nozzle block 72.

An exemplary embodiment comprises many well known components such as gaskets, sealing rings, bushing, biasing devices, and fasteners, many of which have functional equivalents. Although a particular component well known to those skilled in the art may be described in an exemplary embodiment, in other embodiments it may be beneficial to use a different but functionally equivalent component.

The operation of the telescoping filling head 10 is now explained with reference to FIGS. 2–5. During the filling process, a bottle 18 may be initially moved to a position in line with the nozzle portion 14 of the telescoping filling head 10. This position is shown in FIG. 2. In this exemplary embodiment, the bottle 18 may be then elevated slightly so that it comes into contact with the bottle guide 118. During the filling process a bottle 18 may be held steady between the bottle guide 118 and a plate (not shown) on which the bottle 18 may be sitting. Because of the conical shape of the second end 164 of the bottle guide 118, the bottle may adjust slightly relative to the bottle guide 118 so that it properly centers itself with respect to the bottle guide 118.

Although in this exemplary embodiment the bottle 18 may be held steady by the opposing pressures from the bottle guide 118 and a plate which elevates the bottle 18, in other embodiments the bottle 18 may be stabilized by other means and need not necessarily come in contact with the bottle guide 118. In this exemplary embodiment, the telescoping filling head 10 may be mounted on a rotary filling device. In other embodiments, it may be mounted on another type of filling device.

Figure 3:
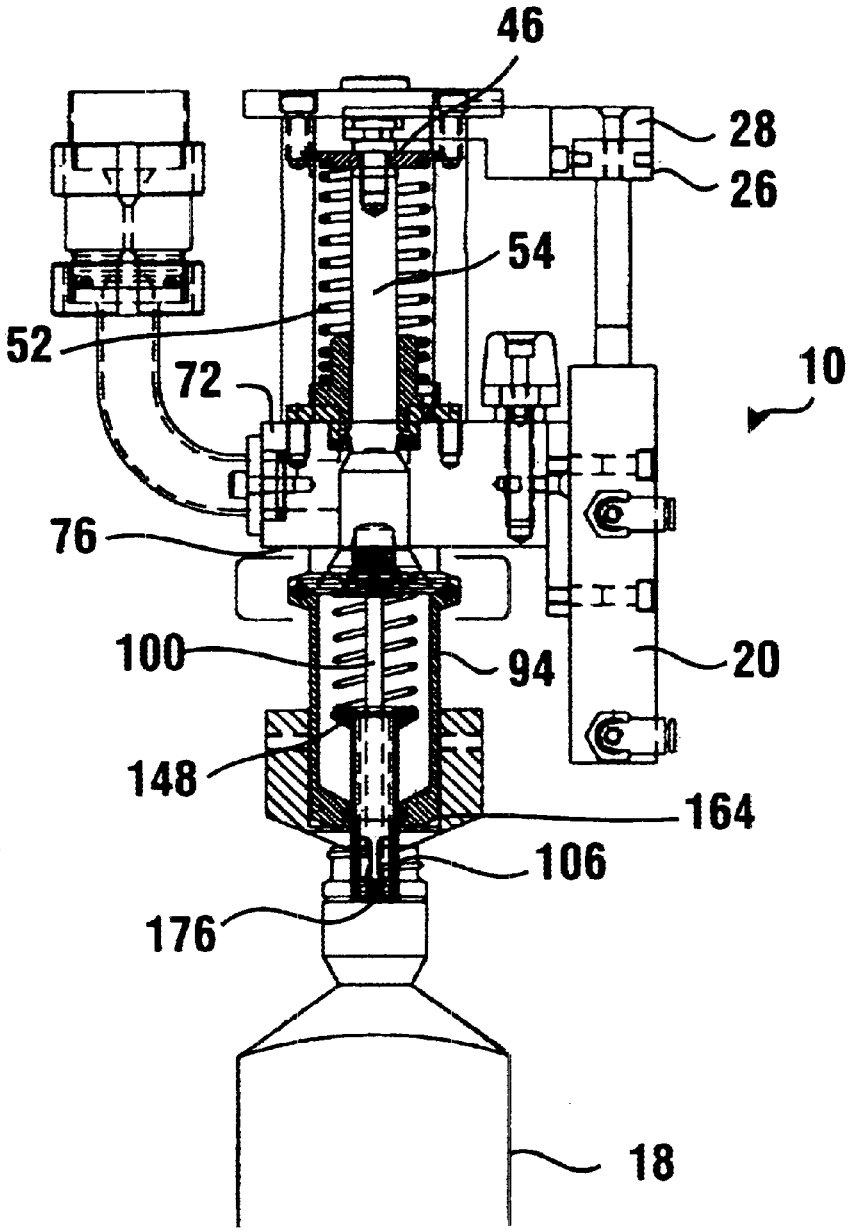
FIG. 3 is a cutaway perspective view of the filling apparatus with the bottle elevated.

Once the bottle 18 is in position, as illustrated in FIG. 3, the air cylinder 20 may be activated to force the driving plate 26 toward the air cylinder 20, causing the driving arm 28 to compress the compression spring 52 as it moves the spring guide 46 toward the nozzle block 72. As the spring guide 46 moves, it forces the nozzle holder 54 and the inner nozzle 100 to move in the same direction. During the operation of the telescoping filling head 10, the distance between the spring guide 46 and the second end 176 of the inner nozzle 100 remains constant. Although in an exemplary embodiment a telescoping filling head is described as being driven and biased using a particular component, in other embodiments it may be beneficial to use one or more different components to provide the drive or bias.

Figure 4:
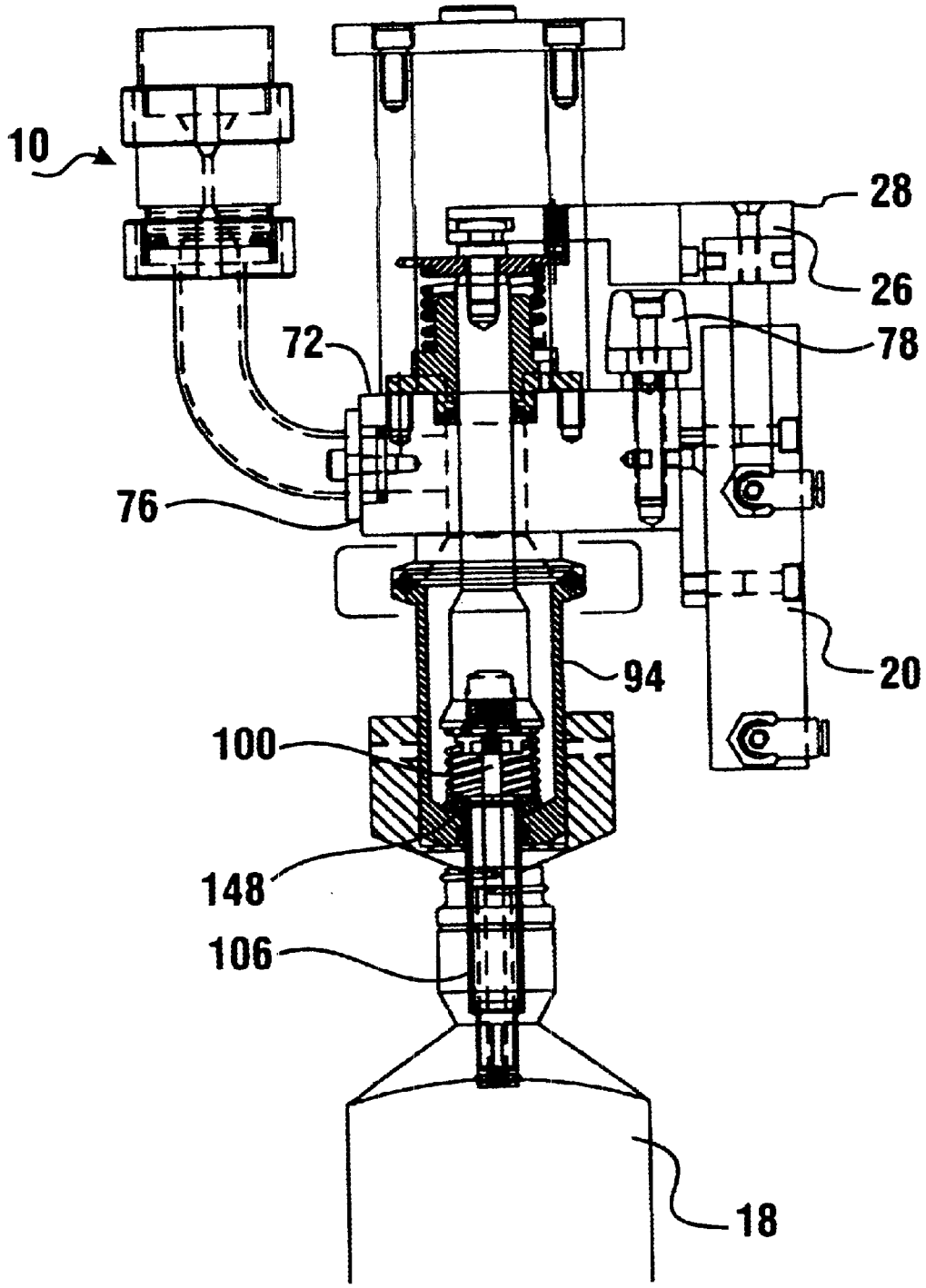
FIG. 4 is a cutaway perspective view of the filling apparatus with the bottle elevated and the nozzle in telescoped position.
Figure 5:
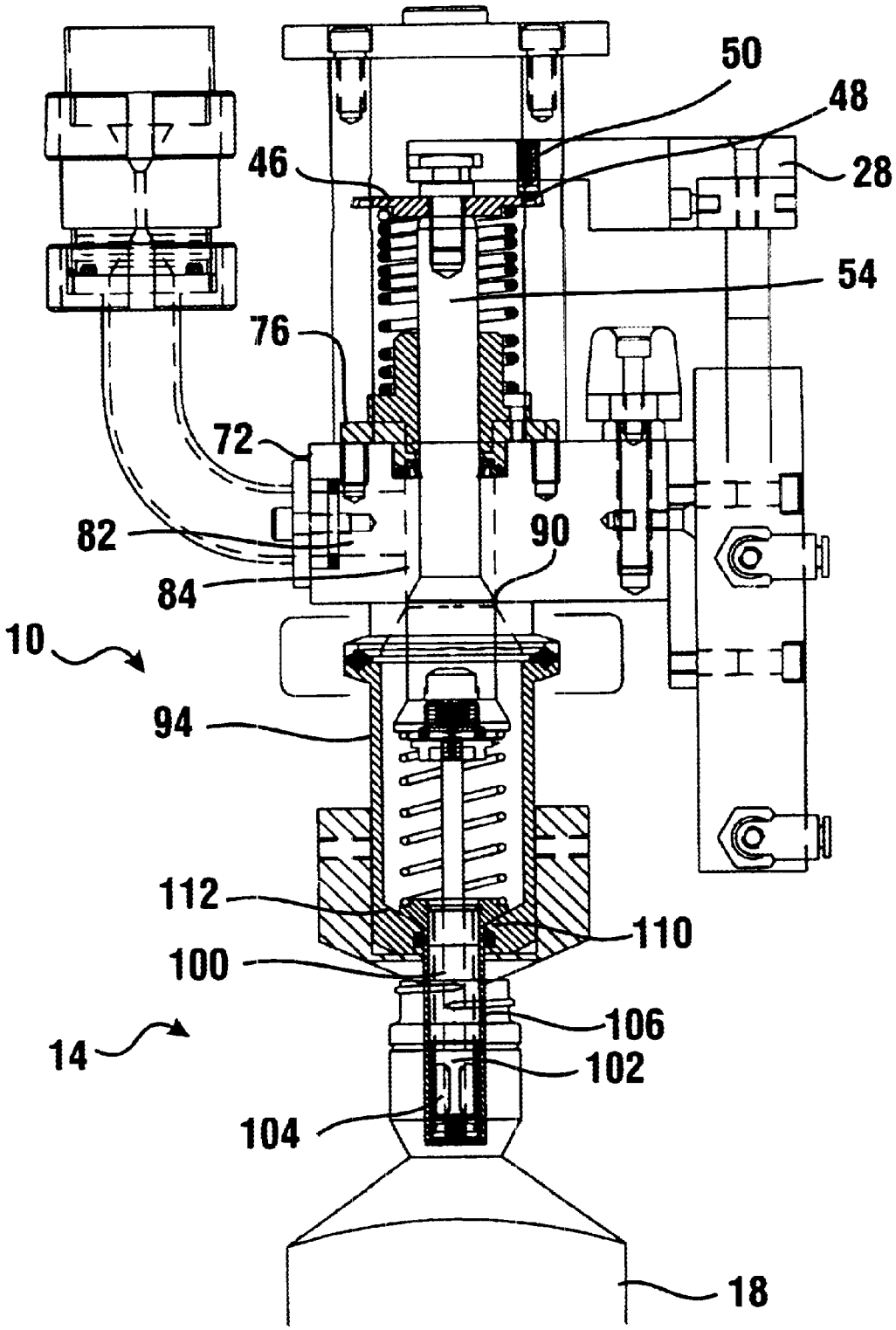
FIG. 5 is a cutaway perspective view of the filling apparatus with the bottle elevated, the nozzle elevated and open for filling.

As the driving arm 28 initially forces the spring guide 46 to move toward the nozzle block 72, both the telescoping nozzle 106 and the inner nozzle 100 move together away from the second surface 76 of the nozzle block 72 into the neck of the bottle 18. As it continues to move, the flanges 148 on the first end of the telescoping nozzle 106 butt against the inner surface of the outer nozzle 94. This position is illustrated in FIG. 4. This causes the telescoping nozzle 106 to stop moving. As the driving arm 28 continues to move toward the nozzle block 72, it forces the second end 176 of the inner nozzle 100 out through the opening in the second end of the telescoping nozzle 106. The motion of the inner nozzle 100 may be stopped when the driving arm 28 hits against the bumper stud 78. Once fully extended, as illustrated in FIG. 5, the inner nozzle tip 102 may be exposed and the product may be delivered through the apertures 104 in inner nozzle tip 102 into the bottle 18.

The liquid product flows through the inlet 82 and into the passage 84 in the center of the nozzle block 72, around the nozzle holder 54, through the outer nozzle 94, around the inner nozzle 100, and through the inner nozzle tip 102 into the bottle 18. The fastest fill rate without foaming can be achieved by directing the flow through the apertures 104 in the inner nozzle tip 102 toward the shoulders of the bottle 18. Although in this exemplary embodiment a particular fluid path is described, in other embodiments it may be beneficial to use a different fluid path so long as the inlet 82 is in fluid connection with one or more apertures 104. In this exemplary embodiment, there are four apertures 104 in the inner nozzle tip 102. In other embodiments, it may be desirable to have fewer or more apertures 104. For example, if the bottle 18 to be filled is triangular in shape, three apertures 104 corresponding to the three shoulders of the bottle 18, would likely permit the bottle 18 to be filled faster.

In this exemplary embodiment, the apertures 104 are positioned by means of a spring plunger 50, attached to the same side of the driving arm 28 as the spring guide 46, at a position that permits the spring plunger 50 to snap into the detents 48 in the spring guide 46, as may be seen in FIG. 14. Although in this exemplary embodiment the position of the apertures 104 may be fixed by means of evenly spaced detents 48 on a spring guide 46 and a spring plunger 50, in other embodiments it may be accomplished by another method.

Filling efficiency also increases when the apertures 104 of the inner nozzle tip 102 are below the base of the neck of the bottle 18. This positioning permits the product to hit the shoulders of the bottle 18 and to flow down the sides of the bottle 18, further minimizing the foaming that may be associated with rapidly dispensing liquid into containers. Because the distance which the inner nozzle 100 extends is generally equal to the distance between the top of the bumper stud 78 and the base of the driving arm 28, the depth of the nozzle in the bottle 18 may be adjusted by moving the bumper stud 78 up or down. In addition minor adjustments may be made by moving the position of the bottle guide 118 on the outer nozzle 94 either toward or away from the nozzle block 72.

Once the bottle 18 is filled, the air cylinder 20 may be activated to force the driving plate 26 away from the air cylinder 20, pulling the nozzle portion 14 up out of the bottle 18. As it initially retracts, because of the pressure of the spring 110 the inner nozzle 100 may be drawn into the stationary telescoping nozzle 106. When the spring 110 is fully extended and the telescoping nozzle 106 butts against the retaining ring 112, the telescoping nozzle 106 and the inner nozzle 100 move in concert out of the bottle 18. Although in an exemplary embodiment a telescoping filling head is described as being driven and biased using a particular component, in other embodiments it may be beneficial to use one or more different components to provide the drive or bias.

In an exemplary embodiment it may be desirable to decrease the velocity of the first stage of the retraction, in order to reduce the load on the retaining ring 112. This may be accomplished by means of a flow control valve 200 placed in operative connection with the valve which exhausts the air cylinder 20 during the first stage of retracting the telescoping filling head. It should be understood that although an air cylinder 20, and an air flow control valve 200 are used in this exemplary embodiment to control the velocity of the retraction of the telescoping filling head, other means known to those skilled in the art may be used. In addition, it may be desirable to use one or more of such means to control any stage of the extension or retraction.

Once the nozzle portion 14 is fully retracted the bottle 18 may be moved away from the telescoping filling head 10.

The interaction between the inner nozzle tip 102 and the telescoping nozzle 106 is generally the primary method of controlling the flow of product into the bottle 18. The primary method may be assisted by a throttling action that occurs within the nozzle block 72. The nozzle holder 54 moves back and forth within a passage 84 through the nozzle block 72. This passage 84 may be connected to an inlet 82. The diameter of the second portion 88 of the passage 84 through the nozzle block 72 may be approximately equal the diameter of the second portion 58 of nozzle holder 54. At rest, the second portion 58 of nozzle holder 54 fills most of the second portion 88 of the passage 84 and blocks most of the product from flowing through the passage 84 in the nozzle block 72 to the outlet 90.

As the nozzle holder 54 moves through the passage 84, in the direction of the second surface 76 of the nozzle block 72, the diameter of the portion of the nozzle holder 54 which may be in the second portion 88 of the passage 84 gradually decreases, until the first portion 56 of the nozzle holder 54 enters the second portion 88 of the passage 84. As the diameter of the portion of the nozzle holder 54 in the second portion 88 of the passage 84 decreases, the flow of product increases around the nozzle holder 54 through the outlet 90 in the second surface 76 of the nozzle block 72. The flow rate of the product reaches its maximum at approximately the same time as the apertures 104 are opened by the full extension of the inner nozzle tip 102 through the telescoping nozzle 106.

When the telescoping portion of the inner nozzle 100 is retracted, the process works in reverse. The flow of the product into the bottle 18 may be stopped by the retraction of the inner nozzle tip 102 into the telescoping nozzle 106. The interaction between the inner nozzle tip 102 and the telescoping nozzle 106 may be assisted by the throttling action that may be created by the interrelationship between the physical dimensions of the nozzle holder 54 and the passage 84 through the nozzle block 72. The nozzle holder 54 moves through the passage 84 in the direction of the first surface 74 of the nozzle block 72, retracting the second portion 58 of the nozzle holder 54 into the passage 84 in the nozzle block 72. As the diameter of the portion of the nozzle holder 54 which may be in the passage 84 gradually increases, the product flow correspondingly decreases around the nozzle holder 54 through the outlet 90 in the second surface 76 of the nozzle block 72. It reaches a minimum flow rate when the second portion 58 of the nozzle holder 54 approximately fills the passage 84. The dimensions of the parts are adapted so that this occurs at approximately the same time the apertures 104 are blocked by retraction of the inner nozzle tip 102 into the telescoping nozzle 106.

As the driving arm 28 drives the motion of the telescoping filling head 10, the alignment compensator 40 may shift slightly within the loosely fitting T-slot 120 in the driving arm 28. This shifting ensures that the parts of the telescoping filling head 10 remain aligned as it moves, so that the parts do not jam or experience uneven wear.

It should be understood that the telescoping filling head 10 as shown and described herein is exemplary. Other telescoping filling heads 10 within the scope of the present invention will be apparent to those having skill in the art from the teachings herein.

Thus the telescoping filling head achieves one or more of the above stated objectives, eliminates difficulties encountered in use of prior devices and systems, solves problems and achieves the desirable results described herein.

Thus the telescoping filling head 10 of the present invention achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it may be constructed and operated, and the advantages and useful results attained; the new and useful structures, devices, elements, arrangements, parts, combinations, systems, equipment, operations, methods and relationships are set forth in the appended claims.

We claim:

1. A telescoping filling head comprising:

a nozzle block including a first and second surface, a passage through said nozzle block from the first surface to the second surface, and at least one inlet into the nozzle block which opens into the passage and which permits the introduction of a product flow into the passage;

a nozzle unit comprising two portions, an inner nozzle and nozzle holder, wherein the nozzle unit passes through the passage and extends out of the first and second surfaces of the nozzle block, wherein the inner nozzle includes an inner nozzle tip and a driving portion, wherein the inner nozzle tip is hollow and includes walls and a closed base end, wherein the walls include one or more apertures adjacent the base end; and wherein the nozzle holder is adapted to transmit a driving force to the inner nozzle;

a telescoping unit extending from the second surface of said nozzle block, said telescoping unit including:

an outer nozzle which includes first and second ends, wherein the outer nozzle is hollow, wherein the first end of the outer nozzle is open and adapted to sealingly connect to the second surface of the nozzle block, wherein the second end of the outer nozzle includes an opening; and a telescoping nozzle which includes first and second ends, and which is hollow and open at both ends, wherein the telescoping nozzle is adapted to slide back and forth sealingly within the opening in the second end of the outer nozzle, wherein the second end of the outer nozzle is adapted to prevent the first end of the telescoping nozzle from exiting the opening in the second end of the outer nozzle; and a first biasing device which biases the nozzle holder away from the first surface of the nozzle block; and a second biasing device which biases the telescoping nozzle away from the second surface of the nozzle block.

2. A telescoping filling head according to claim 1 wherein the nozzle unit has a first and second end and the inner nozzle has a first and second end, and a driving portion which is operatively connected to the inner nozzle tip, wherein the second end of the nozzle holder and the first end of the inner nozzle are adapted to releasably connect together.

3. A telescoping filling head according to claim 1 wherein the outer portion of the first end is flared to correspond to the inner contour of the second end of the outer nozzle.

4. A telescoping filling head according to claim 1 wherein at least one of the first and second biasing devices are springs.

5. A telescoping filling head according to claim 1 wherein the nozzle holder comprises two sections, a first section of a size which permits it to move back and forth in the passage through the nozzle block without contacting the sides of the passage, and a second section of a size which causes it to slide against the walls of the passage as it moves back and forth in the passage.

6. A telescoping filling head according to claim 1 in which the outer nozzle includes outer walls between the first and second ends and which further includes a bottle guide adapted to fit around the outer walls and second end of the outer nozzle, wherein the bottle guide includes an opening which corresponds to the opening in the second end of the outer nozzle and a surface adjacent to the bottle guide opening which is sloped and which peaks at the opening, wherein the sloped surface is adapted to seat and hold a container between the sloped surface of said bottle guide and a plate on which the container sits, and wherein the sloped surface is grooved to permit gas to escape from the container during filling.

7. A telescoping filling head according to claim 1 which further includes a driving arm which is perpendicular to said nozzle unit and which is adapted to drive said nozzle unit back and forth relative to the nozzle block.

8. A telescoping filling head according to claim 7 which further includes a bumper stud which is in operative connection with the first surface of the nozzle block and which is in line with the driving arm, wherein the height of said bumper stud is adjustable to alter the distance traveled by the driving arm.

9. A telescoping filling head according to claim 7 wherein a dual headed alignment compensator is in operative connection with nozzle holder, wherein the driving arm includes a slot adapted to loosely accept one head of the alignment compensator, and wherein the alignment compensator is adapted to respond to misalignment of components of the telescoping filler head by shifting within the slot in the driving arm.

10. A telescoping filling head according to claim 7 wherein the telescoping filling head further includes an alignment cap, cap support rods, and a guide, wherein the cap support rods fix the alignment cap relative to the first surface of the nozzle block at a distance slightly greater than the maximum distance between the driving arm and the nozzle block, wherein the guide is attached to the end of the nozzle holder, and wherein the guide is adapted to fix the rotational position of the apertures in the inner nozzle.

11. A telescoping filling head according to claim 10 wherein the guide includes spaced detents on the surface of the guide facing the alignment cap, and wherein the alignment cap includes a spring plunger on the surface facing the guide, and wherein the rotational position of the nozzle unit can be fixed by snapping the spring plunger into a detent on the guide.

12. A method of reducing fill time for liquid products and reducing foaming by using the telescoping filling head of claim 10 comprising:

(a) selecting and fixing the rotational position of the apertures on the inner nozzle so that the apertures are directed toward the shoulders of the container to be filled when said container is positioned in line with the opening in the second end of the outer nozzle;

(b) positioning a container having shoulders in line with the opening in the second end of the outer nozzle;

(c) driving the inner nozzle into the opening in the container, wherein both the telescoping nozzle and the inner nozzle are driven to their most extreme positions relative to the second surface of the nozzle block;

(d) dispensing a liquid product into the container through the one or more apertures in the inner nozzle, wherein the liquid product hits the shoulders of the container and flows down the walls of said containers thereby minimizing both filling time and foaming.

13. A telescoping filling head according to claim 7 which further includes an air cylinder attached to the driving arm, wherein the air cylinder is adapted to move the driving arm relative to the nozzle block.

14. A telescoping filling head according to claim 13 wherein the air cylinder includes at least one valve, and which further includes a flow control valve attached to the one of the at least one valves of the air cylinder, wherein the flow control valve is adapted to control the velocity of the inner nozzle.

15. A telescoping filling head according to claim 14 wherein one of the at least one valves on the air cylinder is adapted to exhaust the air cylinder during the movement of the inner nozzle, toward the nozzle block and wherein the flow control valve is adapted to decrease the velocity of the inner nozzle.

16. A newly manufactured rotary filling device including one or more telescoping filling heads according to claim 1.

17. An existing rotary filling device including one or more retrofitted telescoping filling heads according to claim 1.

18. A newly manufactured in-line filling device including one or more telescoping filling heads according to claim 1.

19. An existing in-line filling device including one or more telescoping filling heads according to claim 1.

20. A method of reducing fill time for liquid products using the telescoping filling head of claim 1 comprising:

(a) positioning a container in line with the opening in the second end of the outer nozzle;

(b) driving the inner nozzle into the opening in the container, wherein both the telescoping nozzle and the inner nozzle are driven to their most extreme positions relative to the second surface of the nozzle block;

(c) dispensing a liquid product into the container through the one or more apertures in the inner nozzle.

21. A method of using a telescoping filling head according to claim 1 to fill containers comprising:

placing a container below the opening in the outer nozzle; driving the nozzle unit within the nozzle block passage toward the container, wherein the telescoping nozzle initially moves in concert with the inner nozzle through the opening in the outer nozzle, and into the neck of the container to be filled, and wherein the outer nozzle remains stationary relative to the inner nozzle and telescoping nozzle;

halting the motion of the telescoping nozzle;

continuing to drive the inner nozzle through the open end of the telescoping nozzle farther into the neck of the container to be filled thereby exposing one or more openings in said inner nozzle, said outer nozzle and telescoping nozzle both being stationary relative to the inner nozzle;

permitting product to flow through the inlet into the passage and through the one or more openings into the product container;

stopping the flow of product into the product container by driving said nozzle unit through said passage from the second surface toward the first surface, retracting the inner nozzle into the telescoping nozzle, wherein said telescoping nozzle is held stationary against the outer nozzle by operation of the second biasing device;

continuing to drive said nozzle unit through said passage, retracting the inner nozzle and the telescoping nozzle in concert into the outer nozzle; and removing the filled container from below the telescoping filling head.

22. A method of filling containers with liquid using a telescoping filling head comprising:

(a) positioning a container below the opening of a telescoping filling head, wherein the telescoping filling head includes an outer nozzle, a telescoping nozzle, an inner nozzle, and an inlet through which liquid flows into the outer nozzle;

(b) extending the telescoping nozzle into the neck of the container by driving the inner nozzle in concert with the telescoping nozzle through an opening in the outer nozzle, wherein the inner nozzle includes at least one aperture adjacent an end of the inner nozzle which aperture is sealed by the telescoping nozzle;

(c) halting the extension of the telescoping nozzle;

(d) continuing to extend the inner nozzle into the neck of the container by continuing to drive the inner nozzle through telescoping nozzle, thereby exposing the at least one aperture; and (e) permitting the liquid to flow through the outer nozzle, through the extended telescoping nozzle and through the apertures in the inner nozzle into the container.

23. A method of filling containers according to claim 22 further comprising:

(f) halting the flow of liquid by driving the inner nozzle upward into the telescoping nozzle thereby sealing the at least one aperture in the inner nozzle;

(g) driving the inner nozzle in concert with the telescoping nozzle upward into the outer nozzle; and (h) removing the container from the filling position.

24. A method of filling containers according to claim 23 wherein in step (b) the telescoping nozzle is biased to seal the at least one aperture, and wherein in step (f) the telescoping nozzle is biased to slide over the at least one aperture.

25. A method of filling containers according claim 23 wherein in step (a):

the telescoping filling head further includes a bottle guide which covers the lower portion of the outer nozzle and which includes an opening corresponding to the opening in the outer nozzle, wherein a truncated conical shape surrounds the opening, wherein the bottle guide is adapted by said shape to seat the container and to hold it firmly between the telescoping filling head and the plate on which the container rests;

the positioning includes raising the container slightly until it connects solidly with the bottle guide, and in step (h) the removing includes lowering the container slightly to its original position.

26. A method of filling containers according to claim 22 wherein in step (b) the extension of the telescoping nozzle is stopped by the outer shape of the telescoping nozzle which is adapted to be unable to pass completely through the opening in the outer nozzle.

27. A method of filling containers according to claim 22 wherein in steps (b) and (d) an air cylinder attached to a driving arm drives the inner nozzle.

28. A method of filling containers according to claim 27 wherein the driving arm is perpendicular to the inner nozzle, and wherein the air cylinder is parallel to the inner nozzle.

29. A method of filling containers according to claim 27 wherein in steps (b) and (d) the velocity of the inner nozzle is controlled by a flow control valve which is in operative connection with an exhaust valve on the air cylinder.

30. A method of filling containers according to claim 22 wherein in step (a) the fluid connection between the inlet and the outer nozzle comprises a passage through a nozzle block.

31. A method of filling containers according to claim 22 wherein in step (a) the insertion depth of the inner nozzle is primarily determined by the distance between said driving arm and a bumper stud attached to a surface of the nozzle block which is closest to the driving arm.

32. A method of filling containers according to claim 22 further comprising:

(f) positioning one or more of said apertures toward the shoulders of the container using a guide which is adapted to fix said apertures in the inner nozzle in a particular rotational position.

33. A telescoping filling head comprising:

a nozzle block, wherein the nozzle block includes an inlet, and an outer nozzle, wherein said outer nozzle includes a passage and wherein said passage connects to an opening on one surface of the nozzle block and terminates in a second opening in the outer nozzle, wherein the second opening is narrower than the passage, and wherein the inlet is in fluid connection with the second opening;

a telescoping nozzle in sliding connection with the outer nozzle through the second opening, wherein the telescoping nozzle has a first and a second end and includes a passage connecting said ends, wherein the outside portion of the first end of the telescoping nozzle is larger than the second opening in the outer nozzle, and wherein the telescoping nozzle passage is in fluid connection with the outer nozzle passage;

an inner nozzle which includes a driving portion and a nozzle portion, wherein the driving portion of the inner nozzle passes through an opening in the first surface of the nozzle block, wherein the nozzle portion is in sliding connection within the passage in the telescoping nozzle adjacent the second end of the telescoping nozzle, wherein the driving portion is in operative connection with the nozzle portion, wherein the nozzle portion of the inner nozzle includes an open end, a closed end, a walled passage between the ends, and at least one aperture in the walls of the passage adjacent to the closed end, wherein the at least one aperture is in fluid connection with the telescoping nozzle passage;

at least one driving device, wherein the at least one driving device is operative, in conjunction with the driving portion of the inner nozzle, to urge the inner nozzle to move relative to the nozzle block;

at least one first biasing device, wherein the at least one first biasing device is operative to urge the inner nozzle to return to, or to remain in, its position which is farthest from the container;

at least one second biasing device, wherein the second biasing device is operative in conjunction with the at least one driving force to urge the telescoping nozzle to move in concert with the inner nozzle between a first position and a second position relative to the outer nozzle toward the opening of a container to be filled, whereby the telescoping nozzle and the inner nozzle move into the container through the opening of the container; and wherein the at least one driving force is further operative to urge the inner nozzle further into the container between the second position and a third position relative to the outer nozzle, wherein the first end of the telescoping nozzle being larger that the second opening in the outer nozzle prevents the telescoping nozzle from further motion into the container, thereby extending the at least one aperture outside the second end of the telescoping nozzle passage, whereby an interior portion of the container is placed in fluid connection with the inlet to the nozzle block.

* * * * *